United States Patent [19]

Taniguchi et al.

[11] Patent Number: 4,923,730

[45] Date of Patent: May 8, 1990

[54] ANTI-FOULING SURFACE STRUCTURE, ANTI-FOULING COVERING MATERIAL AND METHOD OF PLANTING RIBBONS FOR PRODUCING ANTI-FOULING SURFACE STRUCTURE AND COVERING MATERIAL

[75] Inventors: Yasuyuki Taniguchi, Yokohama; Yutaka Ohwada, Kanagawa; Mitsunori Araki, Nagasaki, all of Japan

[73] Assignee: Dai-Ichi High Frequency Co. Ltd., Tokyo, Japan

[21] Appl. No.: 227,015

[22] Filed: Aug. 2, 1988

[51] Int. Cl.[5] ..... B32B 33/00

[52] U.S. Cl. ..... 428/92; 428/93; 428/94; 428/95; 428/907

[58] Field of Search ..... 428/17, 92, 93, 907, 428/219, 85, 95, 94; 156/72

[56] References Cited

U.S. PATENT DOCUMENTS 3,332,828 7/1967 Faria et al. ..... 428/17
4,576,665 3/1986 Machell ..... 156/72

FOREIGN PATENT DOCUMENTS 104492 6/1982 Japan .
159044 8/1985 Japan .

*Primary Examiner*—Marion C. McCamish
*Attorney, Agent, or Firm*—Rogers & Killeen

[57] ABSTRACT

An anti-fouling surface structure having a multiplicity of ribbons made of plastics thin film and planted on a surface and a method of planting ribbons on a substrate. The ribbons fixed to the surface flutter in sea-water so as to prevent marine growth on the surface. The anti-fouling surface structure may be realized by directly planting ribbons on the surface of a structure to be protected or covering the surface of the structure by a covering material which has a multiplicity of ribbons planted on a substrate sheet or string. The method of planting ribbons comprises the steps of slitting a wide film into a multiplicity of parallel ribbons, flexing and folding the multiplicity of ribbons simultaneously in the direction perpendicular to the slitting direction thereby forming crests ribbons on opposite sides, bonding the ribbons to a substrate at their crests on one side, and cutting the crests opposite to the bonded crests. The method may be such that different substrates are bonded to the crests of the ribbons on opposite sides and then the ribbons are cut at their portions intermediate between the bonded crests.

7 Claims, 9 Drawing Sheets

11
12
12a
12b
12d
12e
13
14
15
16
22
23
24
25
26
27
28
29

ANTI-FOULING SURFACE STRUCTURE, ANTI-FOULING COVERING MATERIAL AND METHOD OF PLANTING RIBBONS FOR PRODUCING ANTI-FOULING SURFACE STRUCTURE AND COVERING MATERIAL

BACKGROUND OF THE INVENTION

The present invention relates to an anti-fouling surface structure for preventing fouling of surfaces of marine structures such as external surfaces of oil rigs, internal surfaces of sea-water pipes, ship's bottoms and so forth which may otherwise be fouled by marine growth. The invention also relates to a covering material for realizing such an anti-fouling surface structure and further to a method of planting ribbons for forming such an anti-fouling surface structure and a covering material.

Fouling of marine structure surfaces by marine growth such as barnacles and mussels is a serious problem. In order to overcome this problem, hitherto, it has been a common measure to coat the surface of the marine structures with paints containing anti-fouling chemicals such as organostannumic compound and copper suboxide. Such anti-fouling measure, however, poses another problem in that the anti-fouling agent in the paint tends to cause marine pollution. In addition, the anti-fouling chemicals in the paints are valid only for a short period, e.g., 2 to 3 years at the longest.

Another anti-fouling method proposed and used conventionally is to plant a multiplicity of filaments on the surface of the marine structure. The filaments flutter in the sea water so as to effectively prevent marine growth. This type of anti-fouling measure is proposed, for example, in Japanese patent applications No. JP-A-57-104492 and JP-A-60-159044. An experiment conducted by the present inventors showed, however, that filaments which are fine enough to ensure sufficient fluttering tends to be deformed, damaged and entangled with one another in a short period, with the result that the fluttering characteristic is impaired to reduce the anti-fouling effect in a very short time.

SUMMARY OF THE INVENTION

Accordingly, an object of the present invention is to provide an anti-fouling surface structure, for preventing fouling of marine structure surfaces for a long period of time without causing any problem such as marine pollution.

According to the present invention, there is provided an anti-fouling surface structure comprising a multiplicity of ribbons made of a thin plastic film planted on a surface.

The ribbon has a thickness which is small enough to ensure sufficient fluttering in sea water and width which is not smaller than about 100 times but not greater than about 1000 times of the thickness. Such ribbons flutter in sea water to effectively prevent marine growth. The fluttering is maintained for a long period and, in addition, the tendency of entanglement of adjacent ribbons is very small.

The ribbon used in the invention is required to have a thickness which ensures long-lasting and sufficiently vigorous fluttering of the ribbon, and to have a quality which can stand a long use in sea water without any damage or deterioration. Plastics are used as the material of the ribbon to meet such demands. More specifically, polyolefines, polyvinylchloride, polyamide fluororesin and so forth are suitably used as the material of the ribbon.

The factors such as thickness, width and length of the ribbon are determined taking into account various conditions such as the fluttering characteristic of the ribbon in sea water, suppression of entanglement, production cost and so forth.

In general, however, the thickness ranges between 5 and 25 μm (0.2 to 1 mil), while width and length preferably range between 1 and 10 mm (0.04 and 0.4 in.) and 10 and 100 mm (0.4 and 4 in.) respectively. A thickness less than 5 μm (0.2 mil) makes it difficult to produce ribbon, while a thickness in excess of 25 μm (1 mil) hinders the fluttering of the ribbon in sea water, resulting in a reduced anti-fouling effect. A ribbon width less than 1 mm (0.04 in.) causes the ribbon to behave in the same manner as filaments to increase the tendency of entanglement of adjacent ribbons.

Conversely, a ribbon width exceeding 10 mm (0.4 in.) impairs the fluttering of the ribbons due to interference.

Fluttering also is suppressed when the ribbon length is not greater than 10 mm (0.4 in.) so that the anti-fouling effect is reduced. On the other hand, a ribbon length greater than 10 mm (4 in.) increases the tendency of entanglement of adjacent ribbons, and the cost thereof.

The ranges of dimensions specified above are therefore preferred. The density at which the ribbons are planted is preferably selected such that the total area of the ribbons is 3 to 100 times as large as the surface on which the ribbons are to be planted.

The surface structure having the ribbons may be formed by directly planting the ribbons on the surface of the marine structure. It is also possible to obtain the surface structure of the invention by preparing a covering sheet composed of a flexible sheet made of fabric, plastics or rubber with the ribbons planted thereon, and covering the marine structure surface with this sheet by means of an adhesive or by wrapping with strap, hot-melt bonding or other suitable means. Multi or mono filament string is also adoptable as a substrate of the covering material.

Accordingly, another object of the present invention is to provide an anti-fouling material which is capable of covering a marine structure surface thereby realizing the anti-fouling surface structure of the invention.

To this end, according to another aspect of the present invention, there is provided an anti-fouling covering material comprising a flexible sheet or string and a multiplicity of thin ribbons made of plastics and planted on the flexible substrate.

Still another object of the present invention is to provide a method of planting ribbons on the surface of a substrate for realizing the anti-fouling surface structure of the invention.

To this end, according to still another aspect of the present invention, there is provided a method of planting ribbons comprising the steps of: slitting a wide film into a multiplicity of parallel long ribbons; folding the multiplicity of long ribbons in directions perpendicular to the direction of slitting and in a zig-zag and undulating manner such that crests are formed on opposite sides; bonding the ribbons to a substrate at the crests on one side; and cutting said ribbons at the crests on the other side opposite to the bonded crests.

The invention also provides a method of planting ribbons comprising the steps of: slitting a wide film into a multiplicity of parallel long ribbons; folding the multiplicity of long ribbons in directions perpendicular to the direction of slitting and in a zig-zag and undulating manner such that crests are formed on opposite sides; bonding the ribbons to a substrate at a the crests on one side and bonding said ribbons at the opposite crests to another substrate; and cutting said ribbons at intermediate portions between the opposite crests.

In this ribbon planting method of the invention, the substrate on which the ribbons are planted is preferably made of various flexible sheet material such as plastic sheets, rubber sheets, paper sheets, cloths, non-woven cloths, metal foils or laminate of such sheets. This, however, is not exclusive and a rigid member having a substantial surface may be used as the substrate. For instance, pipes externally lines with plastics, sheet piles, buoys and ship's bottoms can serve as the substrate.

The slitting of the film into long ribbons is most simply conducted by using a multiplicity of comb-teeth like cutter knives which are movable relative to the film. Obviously, however, the invention does not exclude the use of rotary knives.

The folding or undulation of the multiplicity of long ribbons formed by the slitting is preferably conducted by an undulating tool which has a linear portion contactable with the ribbons and movable in the direction perpendicular to the direction of slitting. More specifically, a pair of undulating tools having similar construction are arranged to oppose each other and, after the long ribbons are laid between these tools, at least one of these tools is moved relative to other until both tools overlap each other, so that the ribbons are folded in a form like N whereby a minimum unit of undulation with crests on opposite sides is formed. In the folded state, the crests of the ribbons are supported by the linear portions of both undulating tools. It is also possible to form a minimum unit of undulation by using an undulating tool having an elongated opening defined by a pair of linear portions and allowing the ribbons to suspend freely in the elongated opening between the linear portions.

A high production efficiency is ensured by using a plurality of pairs of such undulating tools, regardless of whether the production is executed continuously or in a batch manner.

The undulating tool may be constituted by wires but the use of tabular tools is preferred because such tabular tool are not apt to deflect in the direction perpendicular to the undulation. For the purpose of minimizing the deflect, it is effective to form the tool from a material having a large specific modulus such as carbon-fiber reinforced composite.

Bonding of the ribbons to the substrate at the crests of undulation may be effected by various measures. For instance, the bonding may be conducted by adhesion by means of a solvent-type adhesive of polyvinyl or rubber type, or a tow-part type adhesive such as of epoxy or polyurethane type. The bonding also may be effected by welding by employing a hot-melt type adhesive such as ethylene-vinylacetate copolymer, ethylene-acrylic resin copolymer and fusion-bonding epoxy resin placed between the ribbons and the substrate. Bonding by welding without adhesive also is possible when the substrate is made of the same material as the ribbon or a material which can be fused together with the ribbon material.

Among these methods,the welding method is superior from the view point of durability of the roots of the bonded ribbons and bonding speed. Attention must be drawn, however, so as to avoid any melt down of the ribbons when the ribbons to be welded to the substrate surface is made of a thermoplastic resin. To avoid the melt down of the ribbons, it is preferred that the fusion of the materials takes place only at the interface between the ribbon and the substrate. To localize the fusion of the materials, it is advisable to conduct welding by applying an alternating field, high-frequency current or microwave while placing at the interface a suitable energy absorbing material. In consequence, the heating and melting is localized to avoid melt-down of the ribbon material. The bonding also may be conducted by blackening the substrate surface and applying infrared rays from the surfaces of the ribbons or from the reverse side of the substrate.

According to one example of the method for forming the ribbon-planted sheet, an immeltable fabric is coated at its one side with a hot-melt type adhesive and heat is applied to the fabric from the reverse side by a blow of hot air, contact of a heated iron or irradiation with infrared rays.

The cutting of the ribbons at the crests opposite to the bonded crests or the cutting of the ribbons at intermediate portions between both bonded crests may be conducted by means of knives or scissors, although infrared rays or heated iron may be used effectively. It is also possible to employ such a method that the undulating tool is made from an electrically insulating material with nichrome wires embedded in the linear portion thereof serving to fold the ribbons, so that the ribbons contacting the wires may be cut by resistance heating. This method is superior and recommended because of simplicity of the installation, easiness of maintenance and high cutting speed.

According to the ribbon planting method of the present invention, a multiplicity of long ribbons are formed by slitting a wide film and the long ribbons thus formed are undulated and are bonded as a unit to a substrate at the crests of undulation on at least one side thereof. In this state, the ribbons have not been cut short yet so that the ribbons can be handled without difficulty for easy undulating and bonding operations. In the bonded state, the ribbons take the form of a multiplicity of loops partially bonded to the substrate. By cutting the ribbons at the crests opposite to the bonding crests or at their intermediate portions so as to open the loops, ribbons secured to the substrate surface are made to have predetermined lengths, whereby a surface structure having ribbons having a predetermined length and planted thereon is obtained.

The bonding of two substrates to the crests of ribbons on opposite sides of the undulation enables a pair of ribbon-planted structures to be obtained simultaneously after cutting of the ribbons at intermediate portions between the crests on opposite sides. Thus, the production efficiency is almost doubled in such a form of the invention.

BRIEF DESCRIPTION OF THE DRAWINGS

These and other objects, advantages and features of the present invention will become more apparent as the description proceeds when considered with the accompanying drawings in which.

DESCRIPTION OF THE PREFERRED EMBODIMENTS

Figure 1:
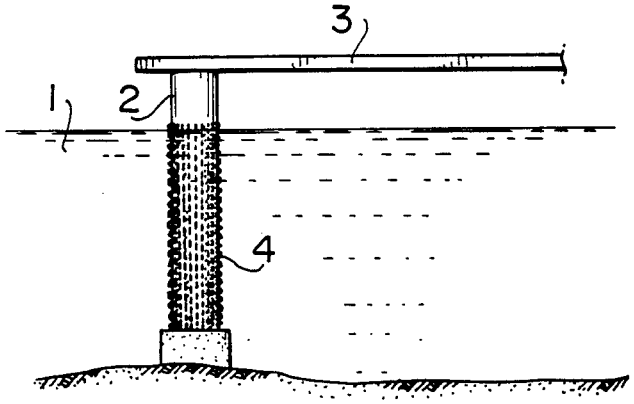
FIG. 1 is a schematic side elevational view of an embodiment of the present invention.

FIG. 1 illustrates an example of offshore structures. This offshore structure has pillars 2 planted on the sea bottom and supporting a platform 3. The pillars 2 therefore are partially immersed in sea-water 1. The portion of each pillar 2 immersed in the sea water 1 is covered with a covering material 4 which provides an anti-fouling surface structure which is effective in preventing marine growth.

Figure 2:
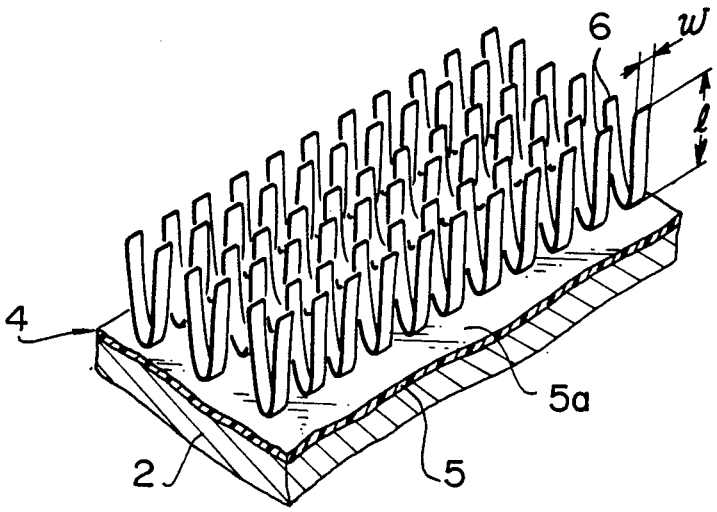
FIG. 2 is an enlarged perspective view showing the surface structure of the embodiment shown in FIG. 1.

As will be seen from FIG. 2, the covering material 4 is constituted by a substrate sheet 5 and a multiplicity of plastic film ribbons planted on one surface of the substrate sheet 5 so as to project therefrom. The ribbons 6 are freed at their one ends and are capable of fluttering in sea water so as to prevent marine growth such as barnacles, mussels, and other lives. In addition, since the direction of fluttering is mainly perpendicular to the major surface of the ribbon, the tendency for the adjacent ribbons to become entangled is reduced. Although in the illustrated embodiment the ribbons in each row are spaced apart from adjacent ones, these ribbons of the same row may be held in contact with adjacent ones.

In order to maintain the anti-fouling effect to prevent marine growth for a long time, each ribbon 6 preferably has a thickness ranging between 5 and 25 μm, width w ranging between 1 and 10 mm and a length 1 ranging between 10 and 100 mm. The substrate sheet 5 is preferably made flexible to facilitate the covering onto the surface of the marine structure. Thus, cloths and plastic sheets are suitably used as the material of the substrate sheet. The covering can be also conducted with the string based covering material.

The covering of the external surface of the pillar 2 of the offshore structure with the covering material 4 having the substrate sheet 5 may be conducted in various known methods. According to one method, the substrate sheet 5 is bonded to the pillar 2 by means of an adhesive such as an epoxy-based one. In such a case, the substrate sheet 5 and the adhesive layer effectively serves as an anti-corrosion coating which effectively protects the pillar surface against corrosion. The covering material 4 may be attached to the portion of the structure which has already been immersed in the sea-water, provided that an aqueous-setting type adhesive is used. Of course, mere wrapping with strap also is available. The corrosion can be suppressed appreciably even when the covering material is simply wound on the pillar without adhesive. When protection against corrosion is a matter of significance, the substrate sheet is preferably made from an environment shut-off material such as plastics or a rubber.

Figure 3:
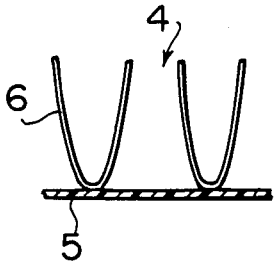
FIG. 3 is a sectional view of a covering material used in the surface structure shown in FIG. 2.
Figure 4:
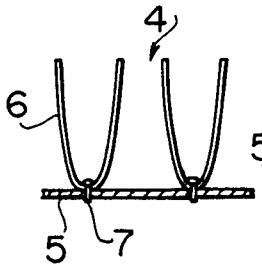
FIGS. 4 and 5 are sectional views of modifications of the covering material.
Figure 5:
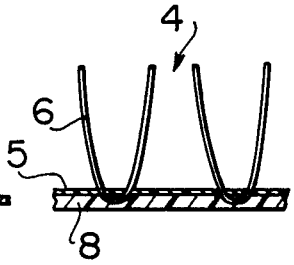
Figure 6:
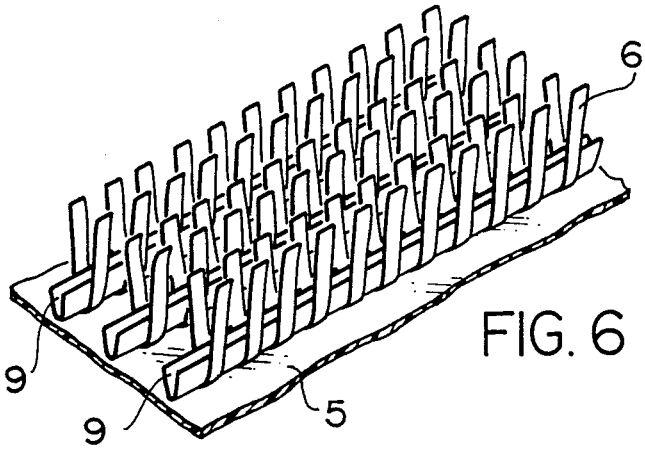
FIG. 6 is a perspective view of a different modification of the covering material.

The ribbons 6 may be fixed to the substrate sheet 5 in various methods. For instance, in the arrangement shown in FIG. 3, U-shaped ribbons 6 is bonded by welding of adhesion, at its bottom to the surface of the substrate sheet. In another example shown in FIG. 4, a U-shaped ribbon 6 is bonded at its bottom to the substrate sheet 5 by means of a thread 7. In another example shown in FIG. 5, a U-shaped ribbon 6 is threaded through the substrate sheet 5 and is fixed to the substrate sheet by means of a backing layer 8 which is fixed to the reverse side of the substrate sheet 5. In still another example shown in FIG. 6, a U-shaped reinforcement sheet 9 is arranged on the bottoms of a multiplicity of U-shaped ribbons 6 and the reinforcement sheets are fixed to the substrate sheet by sewing or bonding. Among these methods, the bonding by welding shown in FIG. 3 is most preferred because it provides a high strength and production efficiency. Welding can be conducted with or without hot melt adhesive. The ribbon 6 need not always be of U-shape. For instance, it is possible to fix linear ribbons to the substrate sheet 5 at their one ends.

Figure 7:
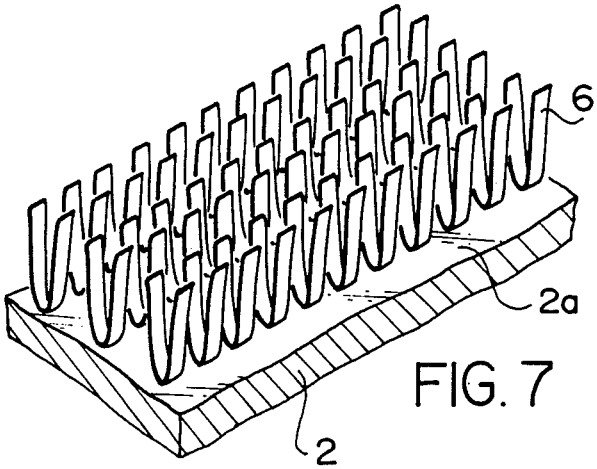
FIG. 7 is a perspective view of another embodiment of the surface structure according to the invention.

The anti-fouling structure of the present invention can be realized by directly bonding the ribbons 6 to the surface 2*a* of the pillar 2 as shown in FIG. 7. It will be understood that such an arrangement also is effective in preventing marine growth by virtue of fluttering of the ribbons 6. The surface structures as shown in FIGS. 2 and 7 can be applied not only to the submerged pillars 2 shown in FIG. 1 but also to the surfaces of various marine or offshore structures used in sea water such as the external surfaces of underwater members of oil rigs, internal surfaces of sea-water pipes, ship's bottoms and so on.

EXAMPLE

Samples were prepared by effecting the following treatments on different pieces of hard polyvinylchloride pipe having a nominal diameter of 300 mm and length of 600 mm.

A (Example of Invention)

A ribbon-planted sheet was prepared by fixing ribbons of high-density polyethylene to a cloth. The ribbon had a thickness of 10 μm, width of 3 mm and a length of 30 mm. The ribbons were planted at such a density that the area of the ribbon per unit area (cm) of the cloth is about 10 cm. The thus prepared anti-fouling sheets were wrapped over the entire surface of the vinylchloride pipe.

B (Comparison Example)

A sheet was prepared by planting, in place of the polyethylene ribbon, polypropylene filaments of about 10 μm dia in the same manner as A. The sheet was wrapped over the entire surface of the pipe.

C (Comparison Example)

A sheet was prepared by planting, in place of the polyethylene ribbon, polypropylene filaments of about 50 μm dia in the same manner as A. The sheet was wrapped over the entire surface of the pipe.

D (Comparison Example)

No treatment was conducted (naked polyvinylchloride pipe).

The samples were placed in sea-water near the shore of Shirahama Bay, Wakayama Prefecture, Japan, in January and were held there for 12 months. Samples C and D showed heavy deposition of marine lives such as serpulas, barnacles, ascidias and so forth to a thickness in excess of 20 mm. The sample B showed a lighter deposition but the planted filaments were found to have been oppressed to such a degree that they can no more flutter. On the other hand, the sample A embodying the present invention showed almost no deposition of marine lives, and the ribbons were capable of fluttering without any restriction.

The filaments of 10 μm dia. used in sample B initially showed fluttering characteristic equivalent to that showed by the ribbons of 10 μm thick used in the sample A embodying the invention. The reason will be described.

The ribbon having a width b and a thickness t has a second moment of area I which is given as follows.

$$I = bt^3/12$$

The force exerted by sea water on the ribbon is proportional to the width b. Assuming that the resistance coefficient of the ribbon is 2, the force exerted by the sea-water is expressed by 2bf, where f is a constant including flowing velocity and length of the fluttering member. Therefore, the amount of deflection of the fluttering member is proportional to a value which is given as follows.

$$2bf \div I = 24f/t^3 \quad (1)$$

On the other hand, the filament having a diameter d exhibits a second moment of area I which is expressed as follows.

$$I = \pi d^4/64$$

Assuming that the resistance coefficient is 1, the force of sea water acting on the filament is expressed by df. The deflection amount, therefore, is proportional to a value which is given by the following formula.

$$df \div I = 20f/d^3 \quad (2)$$

From these formula (1) and (2), it will be seen that a filament having a diameter equal to the thickness of a ribbon can flutter in the same manner as the ribbon in sea water.

Thus, the ribbon and the filament exhibit an equivalent fluttering characteristic in sea water in the beginning period, but the filament reduces its fluttering characteristic in a comparatively short time though the ribbon maintains its initial fluttering characteristic for a long time, thus assuring a long-lasting anti-fouling effect to prevent marine growth. The fact that the fluttering surface prevent the marine growth is also reconfirmed. Probably, marine lives don't intend to cling to the substrate which has less observed stiffness than their own stiffness.

A description will be made hereinunder as to an apparatus for planting ribbons on a substrate sheet so as to form the covering material 4 of FIG. 3.

Figure 8:
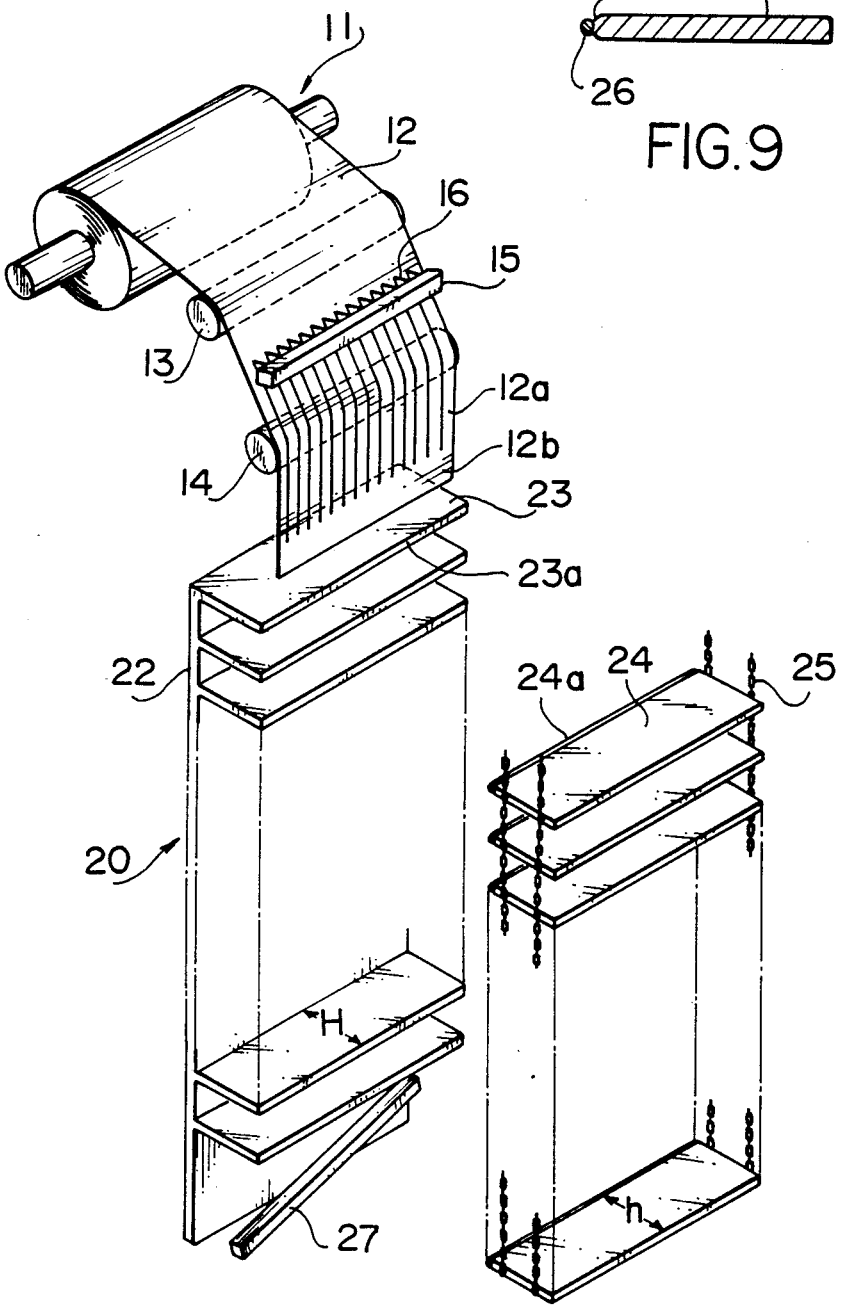
FIG. 8 is a schematic perspective view of an example of an apparatus suitable for use in carrying out a method of the invention for planting ribbons.

FIG. 8 is a schematic perspective view of a batch-type apparatus for manually carrying out the production method of the invention. The apparatus has a pay-off reel 11 for paying off a film 12 which is to be slitted into a multiplicity of long ribbons as will be explained later. In this embodiment, the film 12 is made of a thermoplastic resin such as a high density polyethylene. The thickness of the film is determined in accordance with the thickness of the ribbons to be planted. In this embodiment, the film thickness is selected to be about 10 μm. The width of the film 12 is determined in accordance with the width of the ribbon-planted sheet to be formed in a single batch of the production. In this embodiment, the width is selected to be 600 mm.

Under the pay-off reel 11 are disposed guide rolls 13, 14 and a slitting device 15. The slitting device 15 has a plurality of slitter knives which are arranged in parallel at an interval corresponding to the width of the ribbons to be formed. Thus, the film is slitted into a multiplicity of long ribbons 12*a* as it is made to pass through the slitting device 15. In this embodiment, the ribbons have a width of 3 mm so that the slitter knives also are arranged at an interval of 3 mm. Obviously, the parallel slitter knives may be substituted by rotary cutter having a multiplicity of rotary cutting blades.

Figure 9:
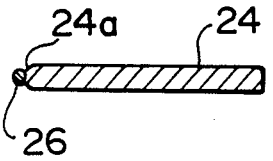
FIG. 9 is a sectional view of a second blade in the apparatus shown in FIG. 8.

Under the slitting device is disposed a ribbon undulating means 20 which is capable of simultaneously undulating the multiplicity of long ribbons 12*a*. The ribbon undulating means 20 has a multiplicity of horizontal first blades 23 which are secured to a vertical supporting wall 22 at a predetermined interval and a multiplicity of second horizontal blades 24 which are interconnected through flexible wire-like members, e.g., chains 25. The first and second blades 23 and 24 serve as undulating tools. Namely, these blades have linear or straight edges 23*a* and 24*a* which are capable of contacting all the ribbons 12*a* so as to press and fold these ribbons in the direction perpendicular to the direction of slitting. Since the second blades 24 are suspended by flexible members 25 as explained before, the operator can manually put these blades 24 one by one into the gaps between the adjacent two first blades 23 from the front side towards the vertical supporting wall 22. The arrangement may be such that suitable guide members are provided so as to hold the respective second blades 24 and to guide them into the gaps between adjacent first blades 23, thereby facilitating the insertion of the second blades into these gaps. Preferably, the first blades 23 have a height H which is greater than the height of the undulation, i.e., the distance between the crests on the left and right sides, formed by the ribbons 12*a*, while the height h of the second blades 24 is slightly lower than the height H of the first blades 23, so that the second blades 24 can fully be received in the opposing gaps between the adjacent first blades 23. The second blades 24 are made of, for example, a heat-resistant material such as a calsium silicate board and nichrome wires 26 are embedded in the tips of these second blades as shown in FIG. 9. Although not shown, these nichrome wires are connected to an electrical power supply. As will be seen from FIG. 8, a clamp member 27 for fixing the end of the ribbons is provided on the lower end of the supporting wall 22.

A description will be given hereinunder as to a ribbon plating method which makes use of the apparatus described hereinabove.

Referring again to FIG. 8, the film 12 paid-off from the pay-off reel 11 is made to pass through the guide roll 13 and then through the slitting device 15 having the slitter knives 16. The film 12 after the slitting in the form of a multiplicity of ribbons is then made to turn around the guide roll 14 and tensed downward. In consequence, the film 12 is slitted into a multiplicity of parallel ribbons 12*a* of a desired width by the operation of the slitter knives 16. In order to attain a stable support of the multiplicity of long ribbons 12*a*, the leading end 12*b* of the film 12 is remained without being slit. The operator then holds the leading end 12*b* and further pulls the film downward and fixes the same to the supporting wall 22 by means of the clamp member 27 on the lower end of the supporting wall 22.

Then, the lowermost second blade 24 is driven into the opposing gap between the adjacent first blades 23 from the front side so as to force the multiplicity of ribbons 12*a* into the gap. In consequence, the multiplicity of ribbons 12*a* are folded in an undulating manner in the direction perpendicular to the slitting direction, such that crests 12*d* and 12*e* are formed both on the left and right sides while being supported by the edges of the blades 23 and 24. This folding operation causes the film 12 to be intermittently paid-off the pay-off reel 11 so that a new portion of the film is pulled into the slitting device 15, so that the film has been slitted into ribbons 12*a* before it is fed into the undulating tools constituted by the first and second blades 23 and 24.

The second blades 24 are successively brought into the opposing gaps between the first blades 23 in the like manner and after the uppermost second blade 24 has been put into the opposing gap between the uppermost and the next first blades 23, a sheet-like member 28 constituting the substrate sheet is pressed on the crests 12*d* of the ribbons 12*a* resting on the ends of the first blades 23. The substrate sheet 28 used in this embodiment has a hot-melt type adhesive layer provides on the obverse side thereof and is arranged such that the hot-melt layer contacts the crests 12*d* of the ribbons 12*a*. More specifically, in this embodiment, a sheet of polyester woven cloth of 1 mm thick is used as the substrate sheet 28 and layer of an ethylene-aryl copolymer type hot melt material is applied to the surface of this sheet. For the purpose of bonding the ribbons to the substrate sheet 28, a hot roll 29 is pressed onto the substrate sheet 28 and is made to roll on the latter so that the substrate sheet 28 is heated and pressed against the crests 12*d* of the ribbons 12*a* held by the ends of the first blades 23, whereby the ribbons 12*a* are bonded at their crests 12*d* to the substrate sheet 28. The temperature of the hot roll 29 has been selected and adjusted to be optimum for effecting the heat-bonding of the ribbons to the substrate sheet. In this embodiment, the temperature of the hot roll 29 is about 150° C.

Figures 10, 11, 12, 13:
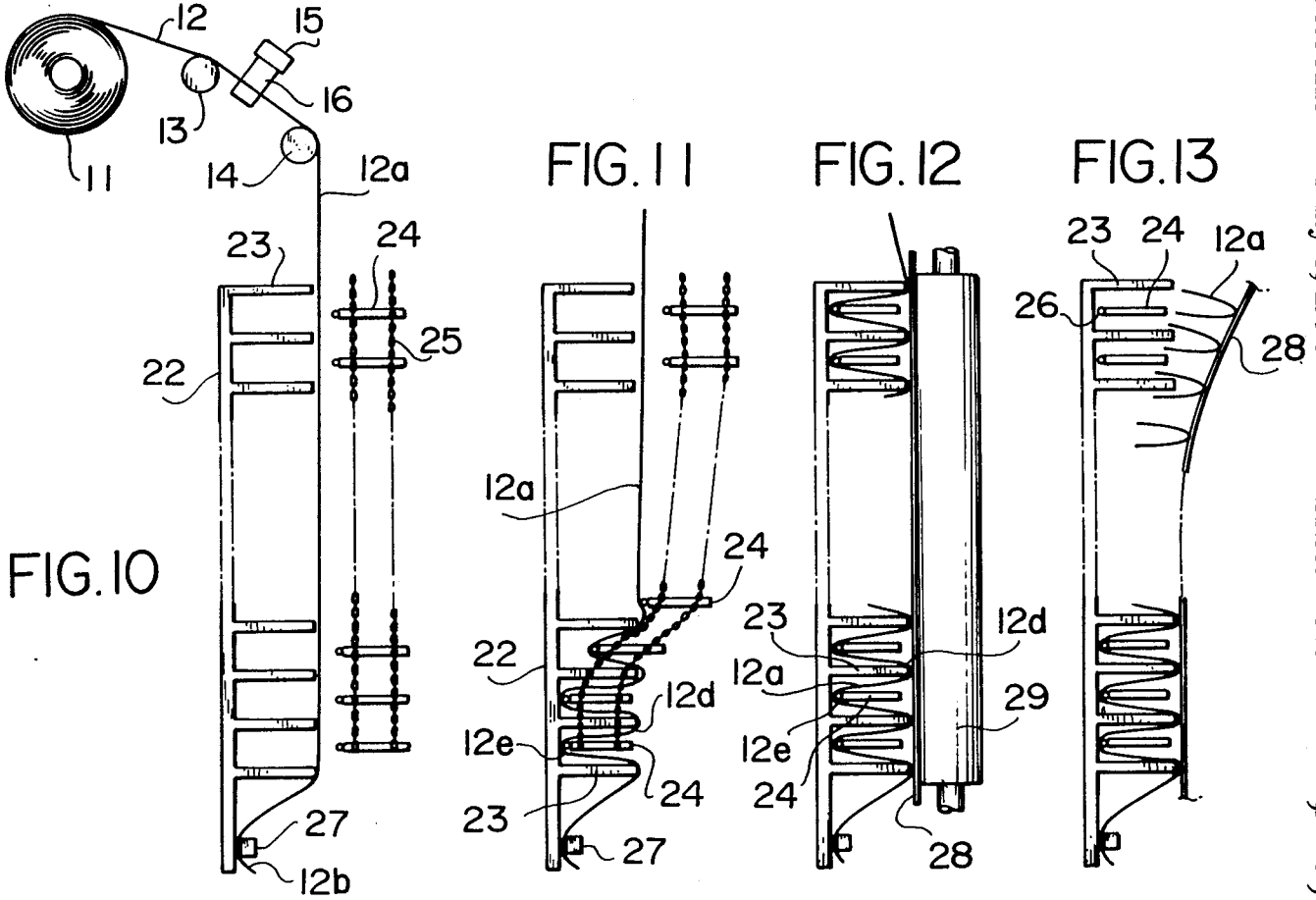
FIGS. 10, 11, 12 and 13 are schematic side elevational views of the apparatus illustrating the ribbon planting operation performed by the apparatus.

Subsequently, the nichrome wires 26 embedded in the ends of the second blades 24 are supplied with electrical power to generate heat and then the substrate sheet 28 is pulled as shown in FIG. 13, whereby the ribbons are fused and cut at their crests 12*e* opposite to the bonded crests 12*d*. It is thus possible to produce a ribbon-planted sheet having thin-film ribbons 12*a* of a predetermined length planted on the substrate sheet 28.

Figure 14:
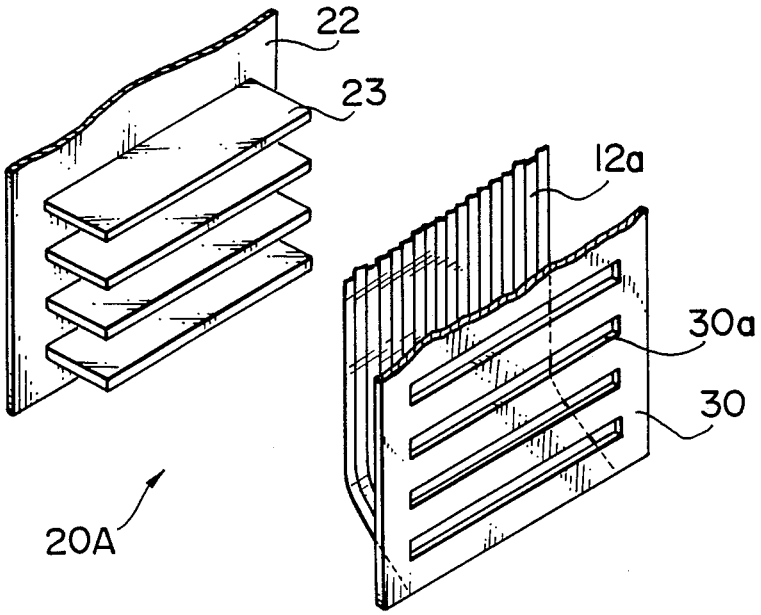
FIG. 14 is a schematic perspective view of a modification of ribbon undulating means used in the apparatus shown in FIG. 8.
Figure 15:
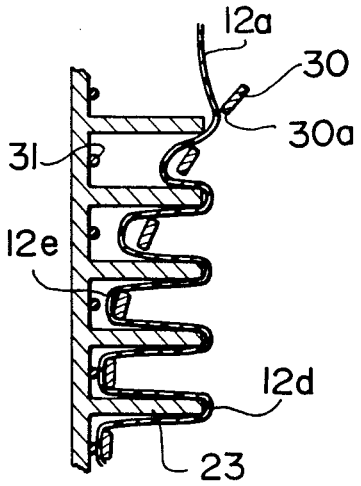
FIG. 15 is a schematic sectional view illustrating the operation of the ribbon undulating means.

In the embodiment shown in FIGS. 8 to 13, tabular members, i.e., the first and second blades are used as the ribbon undulating means 20. This, however, is only illustrative and undulation of the ribbons may be effected by other means. FIG. 14 illustrates an example of such alternative means. The ribbon undulating means 20A of this embodiment includes a multiplicity of blades 23 secured to a supporting wall 22, and a flexible plate 30 provided with elongated apertures 30*a* for allowing the blades 23 to pass therethrough. In this embodiment, the blades 23 and the plate 30 in combination constitute the undulating tool (FIG. 15). The lower end of the slitted film, i.e., the lower ends of the multiplicity of ribbons 12*a*, are fixed to the lower end of the plate 30 and, thereafter, the plate 30 is so driven that the successive blades 23 are brought into the successive apertures 30*a* in the plate 30 from the lowermost one, whereby all the ribbons are folded in the direction perpendicular to the direction of slitting. In consequence, the ribbons are undulated in such a manner that the crests 12*d* and 12*e* are formed on opposite sides. In this case, the crests 12*d* on one side are supported by the end of the blade 23, while the crests 12*e* on the other side are supported by the plate 30. In order to fuse and cut the crests of the ribbons opposite to the bonded crests, nichrome wires 31 are disposed in the portions of the supporting wall 22 between the successive blades 23.

The described embodiment makes use of tabular blades 23 and 24 as the undulating tool. The undulating tools, however, need not always be constituted by tabular members. For instance, they may be formed of wires. It is also possible to arrange such that the supporting wall in support of the blades 23 is laid horizontally and the ribbons are made to ran horizontally along the supporting wall so as to be flexed vertically thereby to form the crests on the upper and lower sides of the path, in contrast to the described embodiments in which the path of the ribbon is formed vertically so as to flex or fold the ribbons in lateral directions thereby to form the crests on the left and right sides of the path.

Figure 16:
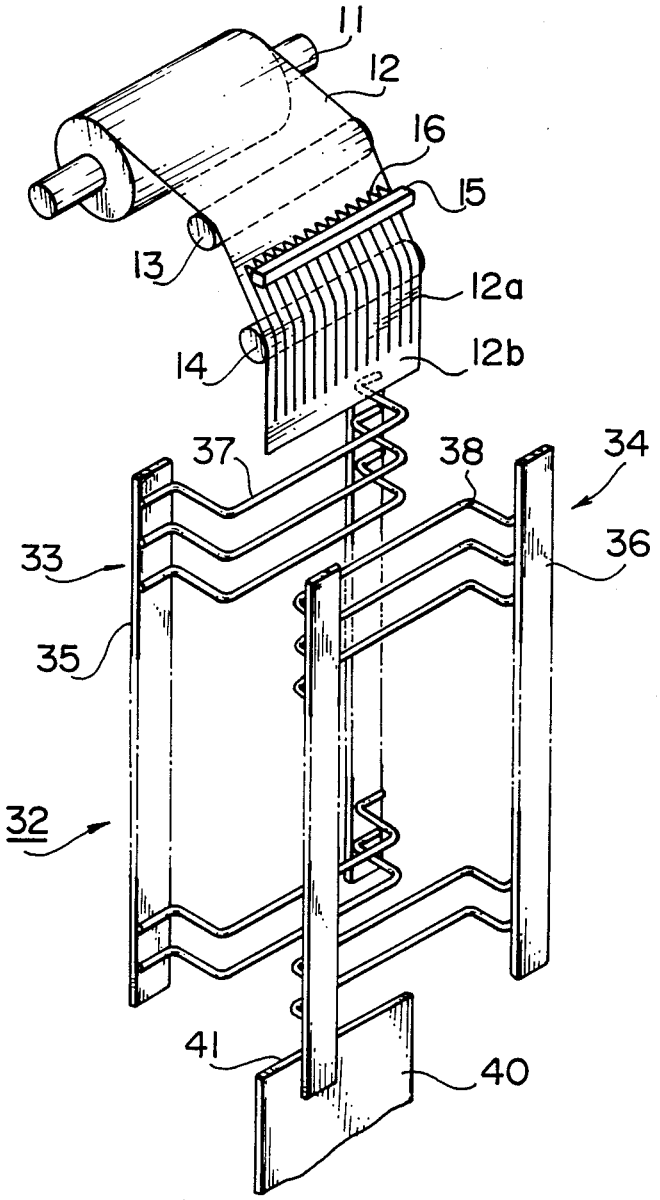
FIG. 16 is a schematic perspective view of an example of apparatus suitable for carrying out a ribbon planting method according to the present invention.

FIG. 16 is a schematic illustration of a batch-type apparatus for manually carrying out another embodiment of the method in accordance with the present invention. In this Figure, the same reference numerals are used to denote the same parts or members as those used in the apparatus shown in FIG. 8 and detailed description is omitted in regard to such parts or members.

This embodiment employs a ribbon undulating means 32 disposed under the slitting device 15 and composed of a first undulating device 33 and a second undulating device 34. The first undulating device 33 and the second undulating device 34 are constituted by vertical flexible pillars 35, 36 and rigid wires 37, 38 secured thereto. The rigid wires 37, 38 serve as undulating tools which contact and flex all the ribbons 12*a*. The pillars 35, 36 are provided with suitable means for bringing them together or allowing them to be separated from each other, e.g., a zipper-type fastener, hooks or the like. A penetrating-type shear 40 is disposed under the undulating means 32. The shear 40 is provided in the end thereof with a cutter 41 which is constituted by a nichrome wire embedded therein and adapted to generate heat when supplied with electrical power. The nichrome wire may be substituted by a cutter blade having a keen cutting edge.

A description will be given hereinunder as to a ribbon planting method of the invention which makes use of the apparatus shown in FIG. 16. The film 12 is paid-off from the pay-off reel 11 and is slitted into a plurality of ribbons of a predetermined width through the slitting device 15. The ends of the ribbons formed by slitting are fixed to the lower end of either one of the undulating devices 33 and 34, and the undulating devices 33 and 34 are progressively brought together from their lower ends, such that the pillars 35 and 36 are progressively jointed to each other. This causes the wires 37, 38 of the undulating devices 33 and 34 to press and flex the slitted film, i.e., the ribbons 12*a*, in alternating directions perpendicular to the direction of length of the ribbons, whereby the ribbons 12*a* are pressed and folded in the direction perpendicular to the longitudinal direction thereof such that the crests 12*d* and 12*e* are formed on the left and right sides of the path of the ribbon 12*a*.

Figure 18:
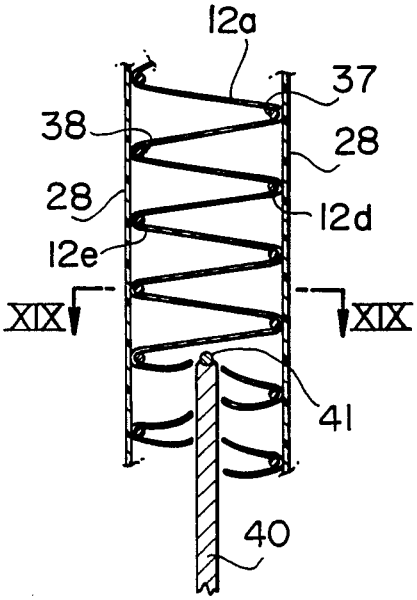
Figure 19:
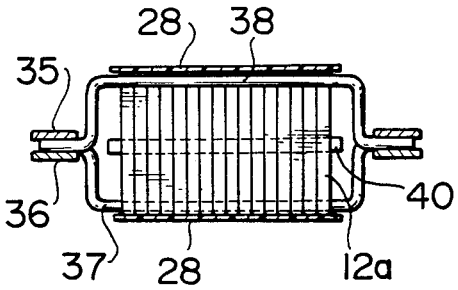
FIG. 19 is a sectional view taken along the line XIX—XIX of FIG. 18.

When the uppermost wires 37 and 38 have been brought together, substrate sheets 28*a* each having a hot-melt layer are brought into contact with the respective crests 12*d* and 12*e* of the ribbons 12 and hot rolls (not shown) are pressed and rolled on the outer surfaces of the substrate sheets, whereby the ribbons 12*a* are bonded to the substrate sheets at their crests 12*d* and 12*e*. Then, the penetration-type shear 40 is made to move into the center of the gap between the wires 37 and 38 as shown in FIGS. 18 and 19, so that the ribbons are cut at their portions intermediate between both bonded crests, whereby a pair of ribbon-planted sheets each having a substrate sheet and ribbons of a predetermined length planted thereon are obtained.

Figure 17:
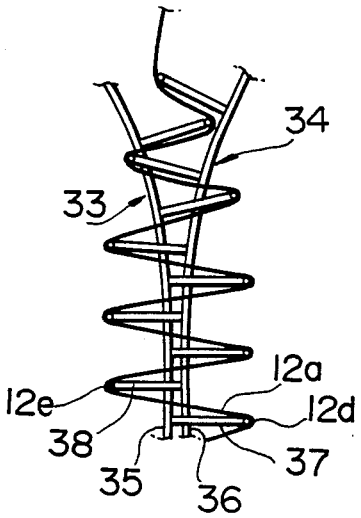
FIGS. 17 and 18 are schematic sectional views illustrating the operation of the apparatus shown in FIG. 16.

This embodiment may be modified such that the wires 37 and 38 are substituted by blades having apertures which allow the penetration-type shear to pass therethrough. The penetration-type shear may be driven from the upper side towards the lower end though in the described embodiment it is driven from the lower side. It is also possible to arrange such that the undulating devices 33 and 34 are laid horizontally in contrast to the described embodiment in which the undulating devices 33 and 34 are arranged to extend vertically. In such a modification, the crests are formed on the upper and lower sides of the path of the ribbons and the penetration-type shear is driven horizontally. FIG. 17 shows a different method in which, after the undulating devices 33 and 34 are brought together to undulate the ribbons 12*a*, the undulating devices 33, 34 and the ribbons 12*a* are demounted and brought to another place where the bonding to the substrate sheets and the cutting of the ribbons are executed.

Figure 21:
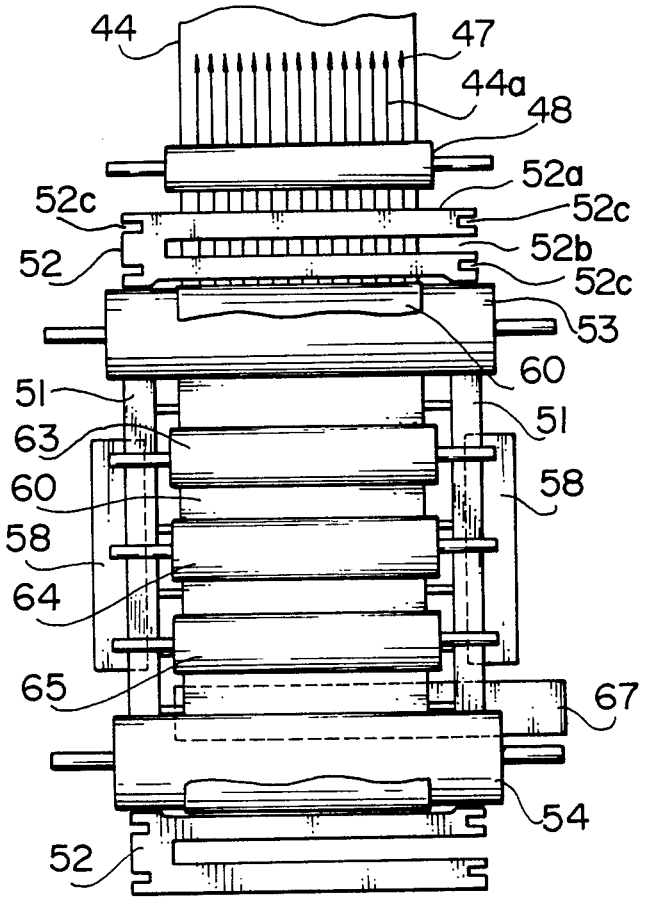
FIG. 21 is a sectional view taken along the line XXI—XXI of FIG. 20.
Figure 20:
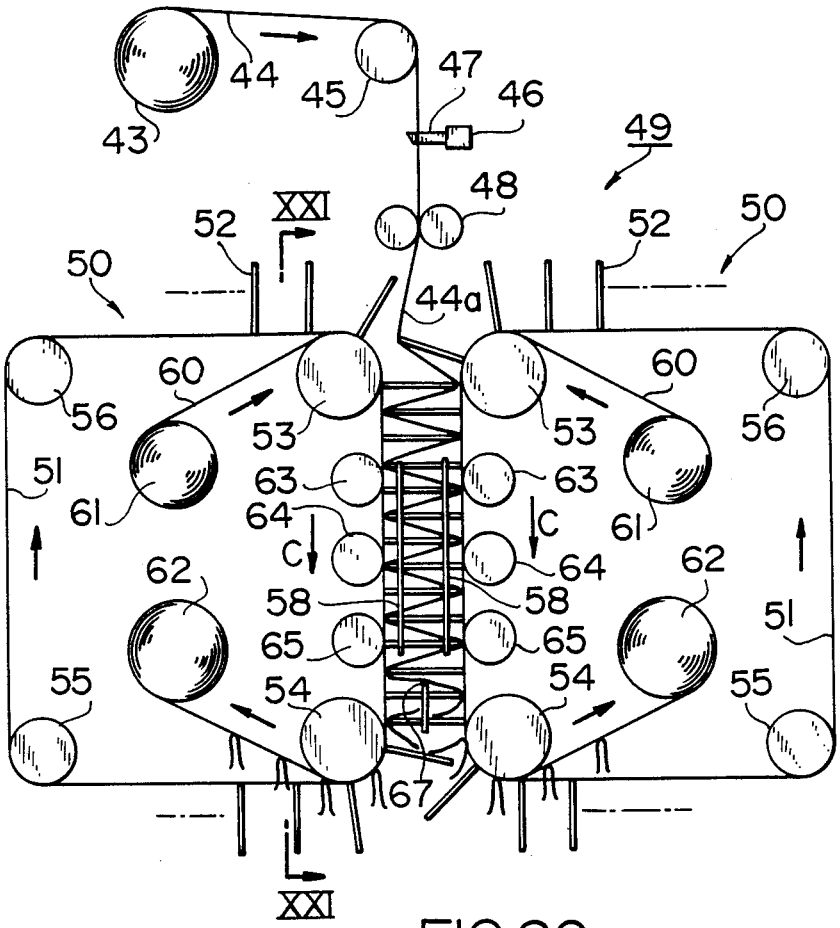
FIG. 20 is a schematic side elevational view illustrating a different example of the apparatus suitable for carrying out the ribbon-planting method of the invention.

FIGS. 20 and 21 schematically illustrate an apparatus for continuously carrying out the method of the invention. The apparatus has a pay-off reel 43 from which a thin film 44 is extracted, a guide roll 45, a slitting device 46 having a multiplicity of knives 47 mounted at a predetermined interval, and a guide roll 48. Under the guide roll 48 is disposed a ribbon undulating means 49 which is composed of a pair of undulating devices 50 and 50 which oppose each other. Each of the undulating devices 50, 50 is provided with a pair of endless belts 51 which are spaced from each other by a distance which is greater than the width of a substrate sheet 60. a multiplicity of blades 52 secured to each belt 51 at a predetermined interval and at a right angle to the surface of the belt, and rolls 53, 54, 55 and 56 around which the endless belts are wound. As will be clearly understood from FIG. 21, each blade 52 is provided with a straight end edge 52*a* capable of contacting all ribbons 44*a* formed by slitting the film 44 and flexing and folding these ribbons in the direction perpendicular to the slitting direction thereby to undulate the ribbons, a central groove 52*b* which is opened at its one end, and grooves 52*c*, 52*c* formed in opposite ends thereof. The central groove 52*b* is intended for allowing a later-mentioned shear knife to pass therethrough, while the grooves 52*c* in opposite ends are intended for allowing later-mentioned guide members to pass therethrough. The rolls 53 and 54 also play the role of feed rollers for feeding a substrate sheet 60 and is adapted to be forcibly driven at a predetermined speed by a driving source which is not shown.

The internal space defined by each endless belt 51 accommodates a substrate supply reel 61 for supplying the substrate sheet 60 and a substrate take-up reel 62 for taking up the substrate sheet 60, so that the substrate sheet 60 is made to run past the rolls 53 and 54. A plurality of rolls 63, 64 and 65 are disposed between the rolls 53 and 54. The rolls 53 and 63 are heating rolls while the rolls 64 and 65 are cooling rolls. The rolls 53 and 63 to 65 serve to heat-bond the crests of the ribbons 44*a* to the substrate sheet 60 which runs therebetween.

Figure 22:
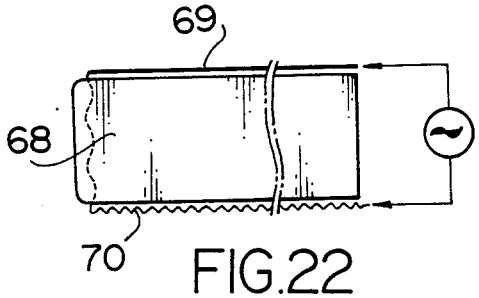
FIG. 22 is a schematic sectional view of a shear knife used in the apparatus shown in FIG. 21.
Figure 23:
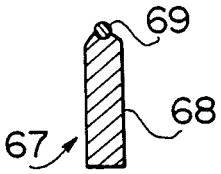
FIG. 23 is a sectional view of the shear knife.

A shear knife 67 is disposed slightly below the rolls 65, 65 at the center of the path formed between these rolls. As will be seen from FIGS. 22 and 23 which show essential portions of the shear knife 67, the shear knife 67 has a main body 68 made of a calcium silicate board and has a nichrome wire 69 embedded in the tip portion of the main body 68. The nichrome wire 69 is connected through a lead wire 70 to a power supply so that it may be supplied with electrical power. As will be seen from FIG. 21, the shear knife 67 is cantilevered and is disposed such that it can pass through the central groove 52*b* in the blade 52. The shear knife 67 need not always be a melt-cut type one employing a nichrome heat-generating wire. For instance, it is possible to use a mechanical cutter having a cutting blade with a keen cutting edge.

A method of planting ribbons employing this apparatus will be explained hereinunder. This method makes use of a thermoplastic film as the film 44, while a substrate sheet having a hot-melt layer on the surface thereof facing the ribbons 44*a* is used as the substrate sheet 60.

Referring to FIG. 20, left and right endless belts 51 each having a multiplicity of blades 52 are adapted to run in the direction of an arrow C in synchronization with each other, and the left and right substrate sheets 60 are fed in the direction of the arrow C at the same speed. Meanwhile, the film 44 is paid-off from the pay-off reel 43 and is slitted into a multiplicity of ribbons 44*a* of a predetermined width by means of the slitting device 46. These ribbons 44*a* are folded in the alternating directions perpendicular to the slitting direction by the blades 52, 52 on the belts 51 such that alternating turns of the ribbons 44*a* are laid one on the other, whereby the ribbons are undulated to have crests on both sides of the path thereof. Then, substrate sheets 60, 60 which have been heated by rolls 53 are brought into contact with the crests on both sides and heating rolls 63 further roll on the substrate sheets 60, 60 so as to heat the latter while pressing them onto the crests of the undulated ribbons 44*a* which are supported on the ends of alternating blades 52. Subsequently, the cooling rolls 64, 65 are made to roll on the substrate sheets 60, 60 so as to cool the latter while pressing them onto the crests of the ribbons held by the ends of the blades 52, whereby the ribbons 44*a* are strongly bonded to the respective substrate sheets at their alternating crests. Then, the ribbons 44*a* are made to move downward in accordance with the movement of the belts 51 so that the intermediate portions of the successive turns of the ribbons between both crests are cut by the shear knife 67 by the heat generated by the nichrome wire 69 as such portions of the ribbons pass the position where the shear knife 67 is disposed, whereby the substrate sheets 60, 60 with the ribbons 44*a* planted thereon are separated from each other. Each substrate sheet 60 after the separation is taken-up by the associated take-up reel 62. It is thus possible to continuously and automatically plant the ribbons on the substrate sheets.

While preferred embodiments of the invention have been described using the specific terms, such description is for illustrative purpose only, and it is to be understood that changes and variations may be made without departing from the spirit or scope of the following claims.

What is claimed is:

1. An anti-fouling structure for inhibiting marine growth on a surface comprising a multiplicity of ribbons on said surface, said ribbons having a thickness of between about five and twenty-five microns, a width ranging between 1 and 10 mm, and a length ranging between 10 and 100 mm so that said ribbons may flutter in water to inhibit marine growth.

2. A structure according to claim 1, wherein said ribbons are planted directly on said surface.

3. A structure according to claim 1, further comprising a covering material attached to said surface, said covering material comprising a flexible substrate to which said ribbons are affixed.

4. A structure according to claim 3, wherein said covering material comprises a substrate selected from the group comprising fabric, plastic, rubber and string.

5. A structure according to claim 3, wherein each of said ribbons has a U-like form and is welded at its bottom to said covering material.

6. A structure for inhibiting marine growth on a submerged surface comprising:

a cover for said surface, said cover flexibly conforming to the shape of said surface; and a multiplicity of flexible generally flat rectangular plastic ribbons affixed to said cover each of said ribbons having a thickness between about 5 and 25 microns for fluttering in water, each of said rectangular ribbons having a width ranging between 100 to 1000 times its thickness, and a length ranging between 10 and 100 mm, and the total surface area of said multiplicity of ribbons ranging between 3 to 100 times the area of the surface enclosed by said cover.

7. The structure as defined in claim 6 wherein said cover comprises a substrate selected from the group comprising fabric, plastic, rubber and string.

* * * * *